US011610545B2

(12) United States Patent
Lou et al.

(10) Patent No.: US 11,610,545 B2
(45) Date of Patent: Mar. 21, 2023

(54) PIXEL CIRCUIT AND DRIVING METHOD THEREOF, AND ORGANIC LIGHT EMITTING DISPLAY APPARATUS

(71) Applicant: Everdisplay Optronics (Shanghai) Co., Ltd., Shanghai (CN)

(72) Inventors: Yeke Lou, Shanghai (CN); Ye Jin, Shanghai (CN)

(73) Assignee: Everdisplay Optronics (Shanghai) Co., Ltd, Shanghai (CN)

( * ) Notice: Subject to any disclaimer, the term of this patent is extended or adjusted under 35 U.S.C. 154(b) by 0 days.

(21) Appl. No.: 17/813,332

(22) Filed: Jul. 19, 2022

(65) Prior Publication Data

US 2023/0038587 A1 Feb. 9, 2023

(30) Foreign Application Priority Data

Aug. 9, 2021 (CN) ..... 202110908779.7

(51) Int. Cl.
*G09G 3/3233* (2016.01)
*G09G 3/3291* (2016.01)
*G09G 3/3266* (2016.01)

(52) U.S. Cl.
CPC ..... *G09G 3/3233* (2013.01); *G09G 3/3266* (2013.01); *G09G 3/3291* (2013.01); *G09G 2320/0233* (2013.01); *G09G 2330/028* (2013.01)

(58) Field of Classification Search
None
See application file for complete search history.

(56) References Cited

U.S. PATENT DOCUMENTS

2019/0266947 A1* 8/2019 Zhou ..... G09G 3/3258
2019/0279573 A1* 9/2019 Zhou ..... G02F 1/061

FOREIGN PATENT DOCUMENTS

| | | | |
|---|---|---|---|
| CN | 102903333 | A | 1/2013 |
| CN | 105225626 | A | 1/2016 |
| CN | 110322831 | A | 10/2019 |
| CN | 111179854 | A | 5/2020 |
| EP | 3471084 | A1 | 4/2019 |

OTHER PUBLICATIONS

The First Office Action dated Mar. 22, 2022 of Chinese Patent No. 202110908779.7.

* cited by examiner

*Primary Examiner* — Christopher J Kohlman
(74) *Attorney, Agent, or Firm* — Qinghong Xu

(57) ABSTRACT

The present disclosure provides a pixel circuit and a driving method thereof, and an organic light emitting display apparatus. The pixel circuit includes: first to ninth transistors, a storage capacitor and a light emitting diode. T2 is used as a driving transistor, T3 is used as a switching transistor, T1, T2 and T3 form a threshold voltage sampling unit of T2, and T4, T8 and T9 form a compensation unit, and the compensation unit is used for compensating the IR Drop generated by a power supply voltage on a line.

18 Claims, 8 Drawing Sheets

10

20

30

PIXEL CIRCUIT AND DRIVING METHOD THEREOF, AND ORGANIC LIGHT EMITTING DISPLAY APPARATUS

CROSS REFERENCE

The present application claims the benefit of priority to the Chinese Patent Application NO. 202110908779.7, filed on Aug. 9, 2021, the contents of which are incorporated herein by reference in their entirety.

TECHNICAL FIELD

The present disclosure relates to the field of display technologies, and in particular, to a pixel circuit and a driving method thereof and an organic light emitting display apparatus.

BACKGROUND

Compared with many display devices, Organic Light Emitting Display (OLED) devices have numerous advantages, such as all-solid-state, self-luminescence, wide viewing angle, wide color gamut, fast response speed, high luminous efficiency, high brightness, high contrast, ultra-thinness, ultra-lightness, low power consumption, wide operating temperature range, having large-size and flexible panels that can be manufactured, and simple manufacturing processes, and can achieve real flexible display, which can best meet people's requirements for future displays.

The organic light emitting display devices include scan lines, data lines, and pixel arrays defined by the scan lines and the data lines. Each pixel of the pixel arrays typically includes an organic light emitting diode and a pixel circuit for driving the organic light emitting diode. Reference may be made to FIG. 1, which is an equivalent circuit diagram of a pixel circuit of an organic light emitting display in the prior art. As shown in FIG. 1, the existing pixel circuit generally includes a switching transistor M1, a driving transistor M2 and a storage capacitor Cs. A gate of the switching transistor M1 is connected to a scan line Scan, and a source of the switching transistor M1 is connected to a data line Data. A gate of the driving transistor M2 is connected to a drain of the switching transistor M1, a source of the driving transistor M2 is connected to a first power supply ELVDD through a first power line (not shown in the figure), and a drain of the driving transistor M2 is connected to an anode of an organic light emitting diode OLED. A cathode of the organic light emitting diode OLED is connected to a second power supply ELVSS through a second power line (not shown in the figure).

When the pixel circuit is operating, the first power supply ELVDD provides a positive power supply voltage Vdd, and the second power supply ELVSS provides a negative power supply voltage Vss. When the switching transistor M1 is turned on through the scan line Scan, a data voltage Vdata provided by the data line Data is stored in the storage capacitor Cs via the switching transistor M1. A gate voltage stored in the storage capacitor Cs turns on the driving transistor M2 to generate a current to drive the organic light emitting diode OLED, ensuring that the OLED continuously emits light within one frame. A formula for calculating an operating current Ioled of the organic light emitting diode OLED, that is, a current flowing through the source and the drain of the driving transistor M2, is:

$$\mathrm{Ioled}=K\times(Vgs-|Vth|)^2;$$

where K is a product of an electron mobility, an aspect ratio and a unit-area capacitance of a thin film transistor, and K is a structural parameter and its value is relatively stable in the same structure, which can be regarded as a constant; Vgs is a gate-source voltage of the driving transistor M2, the gate-source voltage refers to a voltage difference between the gate and the source; and Vth is a threshold voltage of the driving transistor M2.

Since the gate-source voltage Vgs of the driving transistor M2 is equal to a voltage difference between the positive power supply voltage Vdd provided by the first power supply ELVDD and the data voltage Vdata provided by the data line Data, that is, Vdd-Vdata, the operating current of the organic light emitting diode OLED can be calculated according to the following formula:

$$\mathrm{Ioled}=K\times(Vdd-V\mathrm{data}-|Vt|)^2;$$

It can be seen that the operating current of the organic light emitting diode OLED is affected by the threshold voltage Vth of the driving transistor M2 and the power supply voltage Vdd actually applied to the pixel circuit. When the threshold voltage Vth of the driving transistor M2 and the positive power supply voltage Vdd change, the operating current of the organic light emitting diode OLED will substantively change.

Since the brightness of the pixel depends on the operating current of the organic light emitting diode OLED, the changes in the threshold voltage Vth of the driving transistor M2 and the positive power supply voltage Vdd result in the pixel displaying different brightness for data signals of the same brightness.

SUMMARY

The present disclosure provides a pixel circuit and a driving method thereof, and an organic light emitting display apparatus.

The present disclosure provides a pixel circuit, and the pixel circuit includes:

an organic light emitting diode, connected between a first power supply and a second power supply;

a first transistor, a first end of which is connected to a data line, a second end of which is connected to a third node, and a control end of which is connected to a second scan line;

a second transistor, a first end of which is connected to the third node, a second end of which is connected to a fourth node, and a control end of which is connected to a second node;

a third transistor, a first end of which is connected to the second node, a second end of which is connected to the fourth node, and a control end of which is connected to the second scan line;

a fifth transistor, a first end of which is connected to the fourth node, a second end of which is connected to an anode of the light emitting diode, and a control end of which is connected to an emission control line;

a sixth transistor, a first end of which is connected to the second node, a second end of which is connected to a first initialization signal end, and a control end of which is connected to a first scan line;

a seventh transistor, a first end of which is connected to the first initialization signal end, a second end of which is connected to the anode of the light emitting diode, and a control end of which is connected to the second scan line;

a storage capacitor, connected between a first node and the second node; and a compensation unit, a first input end of which is connected to the first power supply, a second input end of which is connected to a second initialization signal end, a first output end of which is connected to the first node, and a second output end of which is connected to the third node.

Correspondingly, the present disclosure further provides a pixel circuit, and the pixel circuit includes:

an organic light emitting diode, connected between a first power supply and a second power supply;

a first transistor, a first end of which is connected to a data line and a control end of which is connected to a second scan line;

a second transistor, a first end of which is connected to a third node, a second end of which is connected to a fourth node, and a control end of which is connected to a second node;

a third transistor, a first end of which is connected to the second node, a second end of which is connected to the fourth node, and a control end of which is connected to the second scan line;

a fifth transistor, a first end of which is connected to the fourth node, a second end of which is connected to an anode of the light emitting diode, and a control end of which is connected to an emission control line;

a sixth transistor, a first end of which is connected to the second node, a second end of which is connected to a first initialization signal end, and a control end of which is connected to a first scan line;

a seventh transistor, a first end of which is connected to the first initialization signal end, a second end of which is connected to the anode of the light emitting diode, and a control end of which is connected to the second scan line;

a tenth transistor, a first end of which is connected to a second end of the first transistor, a second end of which is connected to the fourth node, and a control end of which is connected to the second node;

a storage capacitor, connected between a first node and the second node; and a compensation unit, a first input end of which is connected to the first power supply, a second input end of which is connected to a second initialization signal end, a first output end of which is connected to the first node, and a second output end of which is connected to the third node.

Correspondingly, the present disclosure further provides a driving method for a pixel circuit, and the driving method for the pixel circuit includes: providing the above-mentioned pixel circuit, wherein a scanning cycle of the pixel circuit includes an initialization stage, a threshold voltage sampling and data writing stage and a light emitting stage, and the threshold voltage sampling and data writing stage is between the initialization stage and the light emitting stage;

in the initialization stage, turning on the sixth transistor, and transmitting a first initialization signal to the second node through the sixth transistor, and simultaneously turning on the eighth transistor, and transmitting a second initialization signal to the first node through the eighth transistor;

in the threshold voltage sampling and data writing stage, turning on the first transistor and the third transistor, transmitting a data signal provided by the data line to the third node through the first transistor, and electrically connecting the first end of the second transistor with the control end of the second transistor; and in the light emitting stage, turning on the fourth transistor, the fifth transistor and the ninth transistor, so that the second transistor is turned on to drive the light emitting diode to emit light. In this case, an operating current of the organic light emitting diode is only related to a voltage of the data signal provided by the data line and a second reference voltage provided by the second initialization signal end, and is independent of the threshold voltage of the driving transistor and the first power supply voltage.

Correspondingly, the present disclosure further provides a driving method for a pixel circuit, and the driving method for the pixel circuit includes: providing the above-mentioned pixel circuit, wherein a scanning cycle of the pixel circuit includes an initialization stage, a threshold voltage sampling and data writing stage and a light emitting stage, and the threshold voltage sampling and data writing stage is between the initialization stage and the light emitting stage;

in the initialization stage, turning on the sixth transistor, and transmitting a first initialization signal to the second node through the sixth transistor, and simultaneously turning on the eighth transistor, and transmitting a second initialization signal to the first node through the eighth transistor;

in the threshold voltage sampling and data writing stage, turning on the first transistor and the third transistor, transmitting a data signal provided by the data line to the third node through the first transistor, and electrically connecting the first end of the tenth transistor with the control end of the tenth transistor; and in the light emitting stage, turning on the fourth transistor, the fifth transistor and the ninth transistor, so that the second transistor is turned on to drive the light emitting diode to emit light. In this case, an operating current of the organic light emitting diode is only related to a voltage of the data signal provided by the data line and a second reference voltage provided by the second initialization signal end, and is independent of the threshold voltage of the driving transistor and the first power supply voltage.

Correspondingly, the present disclosure further provides an organic light emitting display apparatus, and the organic light emitting display apparatus includes the above-mentioned pixel circuit.

BRIEF DESCRIPTION OF THE DRAWINGS

The drawings here are incorporated into the specification and constitute a part of the specification, show embodiments consistent with the present disclosure, and are used together with the specification to explain the principle of the present disclosure. Obviously, the drawings in the following description are only some embodiments of the present disclosure. For those of ordinary skill in the art, other drawings can be obtained based on these drawings without creative work.

DETAILED DESCRIPTION

Figure 1:
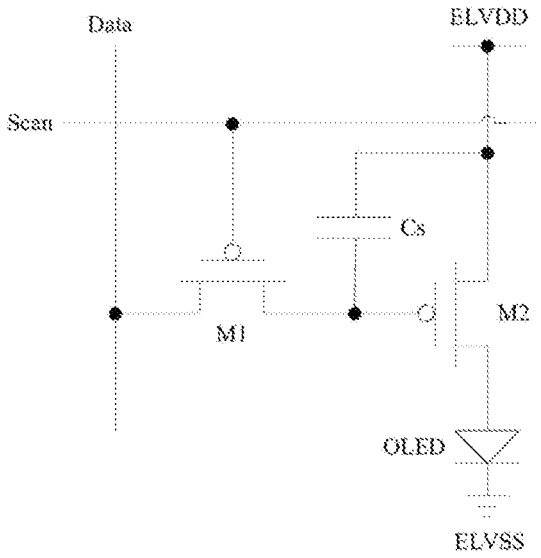
FIG. 1 is an equivalent circuit diagram of a pixel circuit in the prior art.

Embodiments will now be described more fully with reference to the accompanying drawings. However, the embodiments can be implemented in a variety of forms and should not be construed as being limited to examples set forth herein. Rather, these embodiments are provided so that the present disclosure will be more complete and full so as to fully convey the idea of the embodiments to those skilled in this art. The same reference numerals in the accompanying drawings denote the same or similar structures, and the repeated description thereof will be omitted.

First Embodiment

Figure 2:
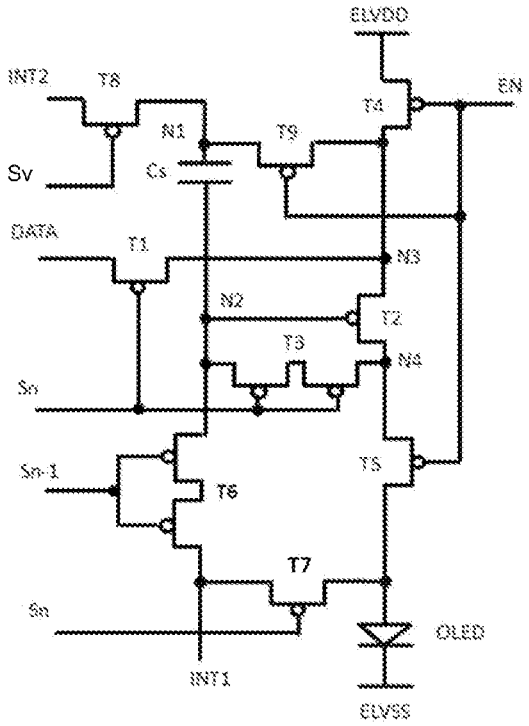
FIG. 2 is an equivalent circuit diagram of a pixel circuit according to a first embodiment of the present disclosure.

Reference is made to FIG. 2, which is an equivalent circuit diagram of a pixel circuit according to a first embodiment of the present disclosure. As shown in FIG. 2, a pixel circuit 10 includes: an organic light emitting diode OLED, connected between a first power supply ELVDD and a second power supply ELVSS; a first transistor T1, a first end of which is connected to a data line DATA, a second end of which is connected to a third node N3, and a control end of which is connected to a second scan line Sn; a second transistor T2, a first end of which is connected to the third node N3, a second end of which is connected to a fourth node N4, and a control end of which is connected to a second node N2; a third transistor T3, a first end of which is connected to the second node N2, a second end of which is connected to the fourth node N4, and a control end of which is connected to the second scan line Sn; a fourth transistor T4, a first end of which is connected to the first power supply ELVDD, a second end of which is connected to the third node N3, and a control end of which is connected to an emission control line EN; a fifth transistor T5, a first end of which is connected to the fourth node N4, a second end of which is connected to an anode of the light emitting diode OLED, and a control end of which is connected to the emission control line EN; a sixth transistor T6, a first end of which is connected to the second node N2, a second end of which is connected to a first initialization signal end INT1, and a control end of which is connected to a first scan line Sn-1; a seventh transistor T7, a first end of which is connected to the first initialization signal end INT1, a second end of which is connected to the anode of the light emitting diode OLED, and a control end of which is connected to the second scan line Sn; an eighth transistor T8, a first end of which is connected to a second initialization signal end INT2, a second end of which is connected to a first node N1, and a control end of which is connected to an initialization scan line Sv; a ninth transistor T9, a first end of which is connected to the first node N1, a second end of which is connected to the third node N3, and a control end of which is connected to the emission control line EN; and a storage capacitor Cs, connected between the first node N1 and the second node N2.

Specifically, the pixel circuit 10 is a 9T1C type circuit structure, including nine transistors (i.e., the first transistor T1 to the ninth transistor T9), one storage capacitor Cs, and one light emitting diode OLED.

The first transistor T1 to the ninth transistor T9 all have first ends, second ends and control ends. The first end is one of a source or a drain, the second end is the other of the source or the drain, and the control end is a gate. In the present embodiment, the first end is the source, and the second end is the drain.

With continued reference to FIG. 2, the light emitting diode OLED is connected between the first power supply ELVDD and the second power supply ELVSS, and the first power supply ELVDD and the second power supply ELVSS are used as driving power supplies of the organic light emitting diode OLED.

The first power supply ELVDD is used to provide a first power supply voltage, and the second power supply ELVSS is used to provide a second power supply voltage, the first power supply voltage is at a high level, and the second power supply voltage is at a low level.

The organic light emitting diode OLED includes the anode and a cathode, the anode of the organic light emitting diode OLED is connected to the second end of the fifth transistor T5 and the second end of the seventh transistor T7, and the cathode of the organic light emitting diode OLED is connected to the second power supply ELVSS. The organic light emitting diode OLED emits light with corresponding brightness according to a driving current flowing therethrough.

A first end of the storage capacitor Cs is connected to the first node N1, and a second end of the storage capacitor Cs is connected to the second node N2. The storage capacitor Cs is used to couple potentials of the first node N1 and the second node N2, maintaining the potential of the second node N2, so that the organic light emitting diode OLED continuously emits the light within one frame time.

The first end of the first transistor T1 is connected to the data line DATA, the second end of the first transistor T1 is connected to the third node N3, and the control end of the first transistor T1 is connected to the second scan line Sn. The second scan line Sn is used to load a second scan signal, the initialization scan line Sv is used to load a third scan signal, and the data line DATA is used to load a data signal.

In the present embodiment, the first transistor T1 is used as a switching transistor, and the second transistor T2 is used as a driving transistor. The first transistor T1 is used to transmit the data signal to the first end of the driving transistor (i.e., the second transistor T2) according to the second scan signal, and the driving transistor (i.e., the second transistor T2) is used to control an operating state of the organic light emitting diode OLED according to the potential of the second node N2. The third transistor T3 is used as the switching transistor, and is used to electrically connect the second end of the driving transistor (i.e., the second transistor T2) to the control end of the driving transistor according to the second scan signal input from the second scan line Sn.

The fourth transistor T4 and the fifth transistor T5 are both used as light emitting control transistors, and their control ends are both connected to the emission control line EN, the emission control line EN is used to load a light emitting control signal. The fourth transistor T4 is used to transmit the first power supply voltage to the first end of the driving transistor T2 according to the light emitting control signal, and the fifth transistor T5 is used to transmit the driving current output by the driving transistor T2 to the organic light emitting diode OLED according to the light emitting control signal.

The second end of the sixth transistor T6 and the first end of the seventh transistor T7 are both connected to the first initialization signal end INT1, and the first initialization signal end INT is used to provide a first initialization signal and a reset signal. The sixth transistor is used as an initialization transistor, and is used to transmit the first initialization signal provided by the first initialization signal end INT1 to the second node N2 according to a first scan signal provided by the first scan line Sn-1. The seventh transistor is used as a reset transistor, and is used to transmit the reset signal provided by the first initialization signal end INT to the anode of the organic light emitting diode OLED according to the second scan signal provided by the second scan line Sn.

The first scan line Sn-1 corresponding to the pixel circuit in the nth row and the second scan line Sn corresponding to the pixel circuit in the n−1th row are the same scan line, where n is an integer greater than or equal to 2.

The first end of the eighth transistor T8 is connected to the second initialization signal end INT2 for transmitting a second initialization signal provided by the second initialization signal end INT2 to the first node N1 according to the third scan signal provided by the initialization scan line Sv, whereby the potential of the first node N1 is a second initialization voltage VINT2.

The ninth transistor T9 is connected between the first node N1 and the third node N3 for changing the potential of the first node N1 according to the light emitting control signal provided by the emission control line EN, so that the potential of the first node N1 changes from the second initialization voltage VINT2 to the first power supply voltage Vdd.

In the present embodiment, the nine thin film transistors (i.e., the first transistor T1 to the ninth transistor T9) of the pixel circuit 10 are all P-type thin-film transistors, and the P-type thin-film transistor is turned on when the control end thereof is at the low level, and is turned off when the control end thereof is at the high level.

Alternatively, the third transistor T3 and the sixth transistor T6 are both double-gate transistors having a low leakage characteristic, which can suppress the change in the potential of the second node N2 when the driving transistor T2 drives the organic light emitting diode OLED to emit the light, and avoid the change in the potential of the second node N2 caused by the leakage of the sixth transistor T6 and the third transistor T3.

In the present embodiment, the first transistor T1, the second transistor T2 and the third transistor T3 form a threshold voltage sampling unit of the driving transistor, and the fourth transistor T4, the eighth transistor T8 and the ninth transistor T9 form a compensation unit for compensating the IR Drop generated by the power supply voltage on the line. The compensation unit has two input ends and two output ends, a first input end is connected to the first power supply ELVDD, a second input end is connected to the second initialization signal end INT2, a first output end is connected to the first node N1, and a second output end is connected to the third node N3.

Correspondingly, the present disclosure further provides a driving method for a pixel circuit, and the driving method for the pixel circuit includes: in a case where a scanning cycle includes an initialization stage, a threshold voltage sampling and data writing stage and a light emitting stage set in sequence:

in the initialization stage, turning on the sixth transistor T6, and transmitting the first initialization signal to the second node N2 through the sixth transistor T6, and simultaneously turning on the eighth transistor T8, and transmitting the second initialization signal to the first node N1 through the eighth transistor T8;

in the threshold voltage sampling and data writing stage, turning on the first transistor T1, and transmitting the data signal provided by the data line DATA to the third node N3 through the first transistor T1, and simultaneously turning on the third transistor T3 to electrically connect the second end of the second transistor T2 with the control end of the second transistor T2; and in the light emitting stage, turning on the fourth transistor T4, the fifth transistor T5 and the ninth transistor T9, so that the second transistor T2 is turned on to drive the light emitting diode OLED to emit the light. In this case, the operating current of the organic light emitting diode OLED is only related to a voltage VDATA of the data signal provided by the data line DATA and the second initialization voltage VINT2 provided by the second initialization signal end INT2, and is independent of the threshold voltage Vth of the driving transistor T2 and the first power supply voltage Vdd.

Figure 3:
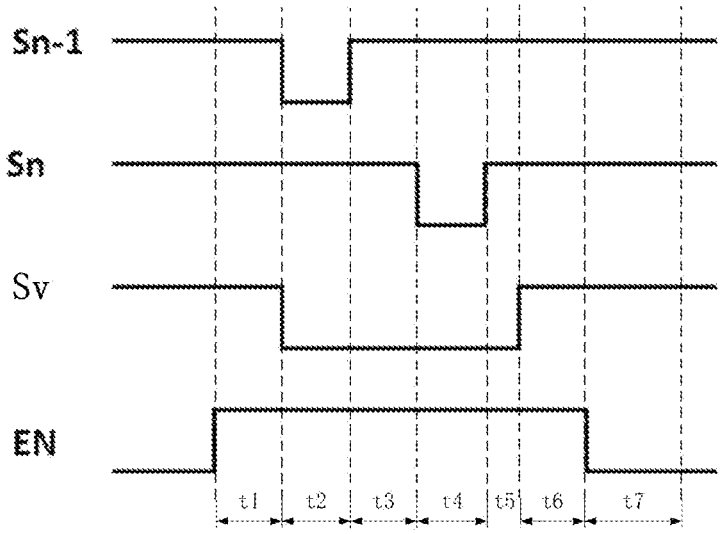
FIG. 3 is a driving timing diagram of a pixel circuit according to a first embodiment of the present disclosure.

Specifically, reference is made to FIG. 3, which is a driving timing diagram of a pixel circuit according to a first embodiment of the present disclosure. As shown in FIG. 3, the scanning cycle of the pixel circuit 10 includes a first time period t1, a second time period t2, a third time period t3, a fourth time period t4, a fifth time period t5, and a sixth time period t6 and a seventh time period t7.

During the first time period t1, the control signal provided by the emission control line EN changes from the low level to the high level, the fourth transistor T4, the fifth transistor T5 and the ninth transistor T9 are turned off, and the organic light emitting diode OLED stops emitting the light.

During the second time period (i.e., the initialization stage) t2, the first scan signal provided by the first scan line Sn-1 changes from the high level to the low level, the sixth transistor T6 is turned on, and the second node N2 is initialized by the first initialization signal end INT1, and at the same time, the third scan signal provided by the initialization scan line Sv changes from the high level to the low level, the eighth transistor T8 is turned on, and the first node N1 is initialized by the second initialization signal end INT2.

During the third time period t3, the first scan signal provided by the first scan line Sn-1 changes from the low level to the high level, the sixth transistor T6 is turned off, and the initialization of the second node N2 is stopped.

During the fourth time period (i.e., the threshold voltage sampling and data writing stage) t4, the second scan signal provided by the second scan line Sn changes from the high level to the low level, the first transistor T1 and the third transistor T3 are turned on, so that the second end of the second transistor T2 is electrically connected to the control end of the second transistor T2 (that is, the gate and drain of the second transistor T2 are short-circuited), and at the same time, the data signal provided by the data line DATA is provided to the third node N3 via the first transistor T1. At this point, the potential of the first node N1 is maintained at VINT2, and the potential of the second node N2 is VDATA+Vth, whereby the sampling of the threshold voltage Vth is completed.

During the fifth time period t5, the second scan signal provided by the second scan line Sn changes from the low level to the high level, the first transistor T1 and the third transistor T3 are turned off, and the writing of the data signal stops.

During the sixth time period t6, the third scan signal provided by the initialization scan line Sv changes from the low level to the high level, the eighth transistor T8 is turned off, and the initialization of the first node N1 is stopped.

During the seventh time period (i.e., the light emitting stage) t7, the control signal provided by the emission control line EN changes from the high level to the low level, the fourth transistor T4, the fifth transistor T5 and the ninth transistor T9 are turned on. Since the fourth transistor T4, the fifth transistor T5 and the ninth transistor T9 are turned on, the potential of the first node N1 jumps from the second initialization voltage VINT2 to the first power supply voltage Vdd, and at the same time, due to the coupling effect of the storage capacitor Cs, the potential of the second node N2 jumps to Vdd−VINT2+VDATA+Vth. At this point, the driving transistor T2 is turned on and outputs the current to drive the organic light emitting diode OLED to emit the light. The operating current Ioled of the organic light emitting diode OLED can be calculated according to the following formula:

$$Ioled=K\times(Vgs-|Vth|)^2$$

where K is a product of an electron mobility, an aspect ratio and a unit-area capacitance of the thin film transistor; Vgs is a gate-source voltage of the driving transistor T2, the gate-source voltage refers to a voltage difference between the gate and the source; and Vth is a threshold voltage of the driving transistor T2.

Since the gate-source voltage Vgs of the driving transistor T2 is equal to a voltage difference between the potential of the second node N2 (Vdd−VINT2+VDATA+Vth) and the first power supply voltage Vdd provided by the first power supply ELVDD, that is, VDATA−VINT2+Vth, the operating current Ioled of the organic light emitting diode OLED can be calculated according to the following formula:

$$Ioled=K\times(VDATA-VINT2)^2.$$

It can be seen that the operating current of the organic light emitting diode OLED is only related to the voltage VDATA of the data signal provided by the data line DATA and the second initialization voltage VINT2 provided by the second initialization signal end INT2, and is independent of the threshold voltage Vth of the driving transistor T2 and the first power supply voltage Vdd, thus the influence of the threshold voltage and the IR Drop on the operating current of the organic light emitting diode can be avoided, which completely solves the influence of the drift of the threshold voltage Vth caused by the manufacturing processes and long-term operation and the IR Drop on the operating current Ioled of the organic light emitting diode OLED, thereby improving the problem of uneven display.

In addition, the second initialization voltage VINT2 provided by the second initialization signal end INT2 is not a power supply signal. After the second initialization voltage VINT2 is used to reset the potential of the first node N1, the current is 0, so the transmission of the second initialization voltage VINT2 does not have the IR Drop issue.

Correspondingly, the present disclosure further provides an organic light emitting display apparatus, and the organic light emitting display apparatus includes the pixel circuit 10 as described above. For details, reference may be made to the above description, which will not be repeated here.

Second Embodiment

Figure 4:
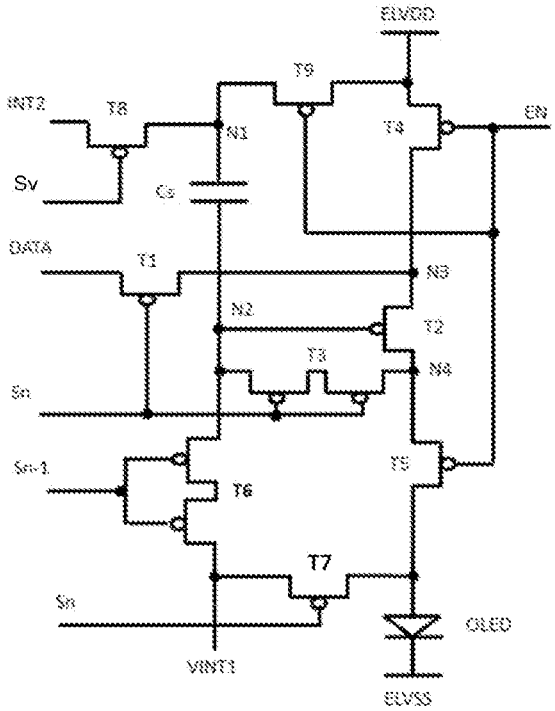
FIG. 4 is an equivalent circuit diagram of a pixel circuit according to a second embodiment of the present disclosure.

Reference is made to FIG. 4, which is an equivalent circuit diagram of a pixel circuit according to a second embodiment of the present disclosure. As shown in FIG. 4, a pixel circuit 20 includes: an organic light emitting diode OLED, connected between a first power supply ELVDD and a second power supply ELVSS; a first transistor T1, a first end of which is connected to a data line DATA, a second end of which is connected to a third node N3, and a control end of which is connected to a second scan line Sn; a second transistor T2, a first end of which is connected to the third node N3, a second end of which is connected to a fourth node N4, and a control end of which is connected to a second node N2; a third transistor T3, a first end of which is connected to the second node N2, a second end of which is connected to the fourth node N4, and a control end of which is connected to the second scan line Sn; a fourth transistor T4, a first end of which is connected to the first power supply ELVDD, a second end of which is connected to the third node N3, and a control end of which is connected to an emission control line EN; a fifth transistor T5, a first end of which is connected to the fourth node N4, a second end of which is connected to an anode of the light emitting diode OLED, and a control end of which is connected to the emission control line EN; a sixth transistor T6, a first end of which is connected to the second node N2, a second end of which is connected to a first initialization signal end INT1, and a control end of which is connected to a first scan line Sn-1; a seventh transistor T7, a first end of which is connected to the first initialization signal end INT1, a second end of which is connected to the anode of the light emitting diode OLED, and a control end of which is connected to the second scan line Sn; an eighth transistor T8, a first end of which is connected to a second initialization signal end INT2, a second end of which is connected to a first node N1, and a control end of which is connected to an initialization scan line Sv; a ninth transistor T9, a first end of which is connected to the first node N1, a second end of which is connected to the first power supply ELVDD, and a control end of which is connected to the emission control line EN; and a storage capacitor Cs, connected between the first node N1 and the second node N2.

Specifically, a difference between this embodiment and the first embodiment is that the second end of the ninth transistor T9 is connected to the first power supply ELVDD instead of the third node N3 (that is, the second end of the fourth transistor T4). In the first embodiment, only when both the fourth transistor T4 and the ninth transistor T9 are turned on, the potential of the first node N1 can be changed from the second initialization voltage VINT2 to the first power supply voltage Vdd. In contrast, in the present embodiment, since the second end of the ninth transistor T9 is directly connected to the first power supply ELVDD, the potential of the first node N1 can be changed from the second initialization voltage VINT2 to the first power supply voltage Vdd as long as the ninth transistor T9 is turned on. However, since the fourth transistor T4, the fifth transistor T5 and the ninth transistor T9 are all controlled by the control signal provided by the emission control line EN, and are turned on or off at the same time, driving manners of the two embodiments are the same.

Correspondingly, the present disclosure further provides a driving method for a pixel circuit. The driving method for the pixel circuit 20 is the same as the driving method for the pixel circuit 10 provided in the first embodiment. For a specific driving timing diagram, reference can be made to FIG. 3.

Similarly, during the light emitting stage t7, the control signal provided by the emission control line EN changes from the high level to the low level, the fourth transistor T4, the fifth transistor T5 and the ninth transistor T9 are turned on. Since the ninth transistor T9 is turned on, the potential of the first node N1 jumps from the second initialization voltage VINT2 to the first power supply voltage Vdd, and at the same time, due to the coupling effect of the storage capacitor Cs, the potential of the second node N2 jumps to Vdd−VINT2+VDATA+Vth. At this point, the driving transistor T2 is turned on and outputs the current to drive the organic light emitting diode OLED to emit the light. The operating current Ioled of the organic light emitting diode OLED is equal to $K\times(VDATA—VINT2)^2$. It can be seen that the operating current Ioled is independent of the threshold voltage Vth of the driving transistor T2 and the first power supply voltage Vdd.

Correspondingly, the present disclosure further provides an organic light emitting display apparatus, and the organic light emitting display apparatus includes the pixel circuit 20 as described above. For details, reference may be made to the above description, which will not be repeated here.

Third Embodiment

Figure 5:
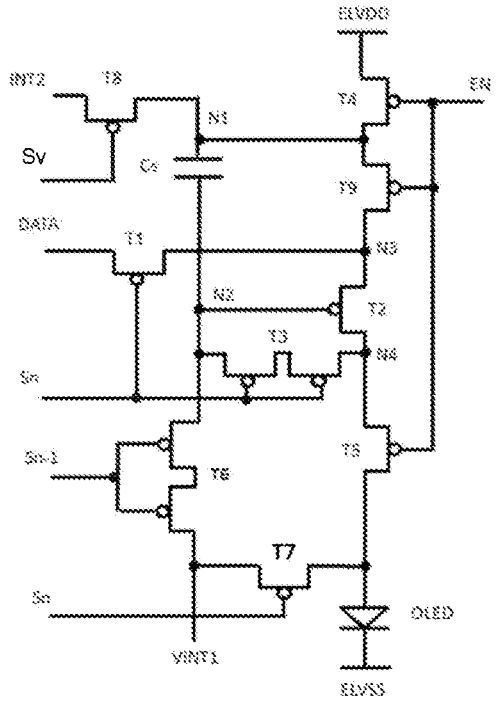
FIG. 5 is an equivalent circuit diagram of a pixel circuit according to a third embodiment of the present disclosure.

Reference is made to FIG. 5, which is an equivalent circuit diagram of a pixel circuit according to a third embodiment of the present disclosure. As shown in FIG. 5, a pixel circuit 30 includes: an organic light emitting diode OLED, connected between a first power supply ELVDD and a second power supply ELVSS; a first transistor T1, a first end of which is connected to a data line DATA, a second end of which is connected to a third node N3, and a control end of which is connected to a second scan line Sn; a second transistor T2, a first end of which is connected to the third node N3, a second end of which is connected to a fourth node N4, and a control end of which is connected to a second node N2; a third transistor T3, a first end of which is connected to the second node N2, a second end of which is connected to the fourth node N4, and a control end of which is connected to the second scan line Sn; a fourth transistor T4, a first end of which is connected to the first power supply ELVDD, a second end of which is connected to a first node N1, and a control end of which is connected to an emission control line EN; a fifth transistor T5, a first end of which is connected to the fourth node N4, a second end of which is connected to an anode of the light emitting diode OLED, and a control end of which is connected to the emission control line EN; a sixth transistor T6, a first end of which is connected to the second node N2, a second end of which is connected to a first initialization signal end INT1, and a control end of which is connected to a first scan line Sn-1; a seventh transistor T7, a first end of which is connected to the first initialization signal end INT1, a second end of which is connected to the anode of the light emitting diode OLED, and a control end of which is connected to the second scan line Sn; an eighth transistor T8, a first end of which is connected to a second initialization signal end INT2, a second end of which is connected to the first node N1, and a control end of which is connected to an initialization scan line Sv; a ninth transistor T9, a first end of which is connected to the first node N1, a second end of which is connected to the third node N3, and a control end of which is connected to the emission control line EN; and a storage capacitor Cs, connected between the first node N1 and the second node N2.

Specifically, a difference between this embodiment and the first embodiment is that the second end of the fourth transistor T4 is connected to the first node N1 instead of the third node N3. In the first embodiment, the first node N1 is connected to the first power supply ELVDD via the fourth transistor T4 and the ninth transistor T9, and only when both the fourth transistor T4 and the ninth transistor T9 are turned on, the potential of the first node N1 can be changed from the second initialization voltage VINT2 to the first power supply voltage Vdd. In contrast, in the present embodiment, since the second end of the fourth transistor T4 is directly connected to the first node N1, the potential of the first node N1 can be changed from the second initialization voltage VINT2 to the first power supply voltage Vdd as long as the fourth transistor T4 is turned on. However, since the fourth transistor T4, the fifth transistor T5 and the ninth transistor T9 are all controlled by the control signal provided by the emission control line EN, and are turned on or off at the same time, the driving manners of the two embodiments are the same.

Correspondingly, the present disclosure further provides a driving method for a pixel circuit. The driving method for the pixel circuit 30 is the same as the driving method for the pixel circuit 10 provided in the first embodiment. For a specific driving timing diagram, reference can be made to FIG. 3.

Similarly, during the light emitting stage t7, the control signal provided by the emission control line EN changes from the high level to the low level, the fourth transistor T4, the fifth transistor T5 and the ninth transistor T9 are turned on. Since the fourth transistor T4 is turned on, the potential of the first node N1 jumps from the second initialization voltage VINT2 to the first power supply voltage Vdd, and at the same time, due to the coupling effect of the storage capacitor Cs, the potential of the second node N2 jumps to Vdd−VINT2+VDATA+Vth. At this point, the driving transistor T2 is turned on and outputs the current to drive the organic light emitting diode OLED to emit the light. The operating current Ioled of the organic light emitting diode OLED is equal to $K\times(VDATA-VINT2)^2$. It can be seen that the operating current Ioled is independent of the threshold voltage Vth of the driving transistor T2 and the first power supply voltage Vdd.

Correspondingly, the present disclosure further provides an organic light emitting display apparatus, and the organic light emitting display apparatus includes the pixel circuit 30 as described above. For details, reference may be made to the above description, which will not be repeated here.

Fourth Embodiment

Figure 6:
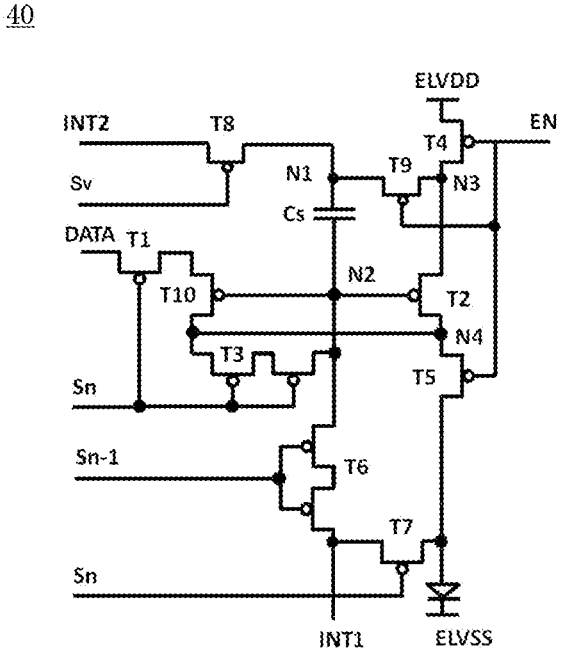
FIG. 6 is an equivalent circuit diagram of a pixel circuit according to a fourth embodiment of the present disclosure.

Reference is made to FIG. 6, which is an equivalent circuit diagram of a pixel circuit according to a fourth embodiment of the present disclosure. As shown in FIG. 6, a pixel circuit 40 includes: an organic light emitting diode OLED, connected between a first power supply ELVDD and a second power supply ELVSS; a first transistor T1, a first end of which is connected to a data line DATA, and a control end of which is connected to a second scan line Sn; a second transistor T2, a first end of which is connected to the third node N3, a second end of which is connected to a fourth node N4, and a control end of which is connected to a second node N2; a third transistor T3, a first end of which is connected to the second node N2, a second end of which is connected to the fourth node N4, and a control end of which is connected to the second scan line Sn; a fourth transistor T4, a first end of which is connected to the first power supply ELVDD, a second end of which is connected to the third node N3, and a control end of which is connected to an emission control line EN; a fifth transistor T5, a first end of which is connected to the fourth node N4, a second end of which is connected to an anode of the light emitting diode OLED, and a control end of which is connected to the emission control line EN; a sixth transistor T6, a first end of which is connected to the second node N2, a second end of which is connected to a first initialization signal end INT1, and a control end of which is connected to a first scan line Sn-1; a seventh transistor T7, a first end of which is connected to the first initialization signal end INT1, a second end of which is connected to the anode of the light emitting diode OLED, and a control end of which is connected to the second scan line Sn; an eighth transistor T8, a first end of which is connected to a second initialization signal end INT2, a second end of which is connected to a first node N1, and a control end of which is connected to an initialization scan line Sv; a ninth transistor T9, a first end of which is connected to the first node N1, a second end of which is connected to the third node N3, and a control end of which is connected to the emission control line EN; a tenth transistor T10, a first end of which is connected to a second end of the first transistor T1, a second end of which is connected to the fourth node N4, and a control end of which is connected to the second node N2; and a storage capacitor Cs, connected between the first node N1 and the second node N2.

Specifically, the pixel circuit 40 is a 10T1C type circuit structure, including ten transistors (i.e., the first transistor T1 to the tenth transistor T10), one storage capacitor Cs, and one light emitting diode OLED.

A difference between this embodiment and the first embodiment is that the pixel circuit 40 further includes the tenth transistor T10, and the tenth transistor T10 and the driving transistor T2 form a mirror structure. Since the threshold voltage of the tenth transistor T10 is substantially the same as the threshold voltage of the second transistor T2, the threshold voltage of the tenth transistor T10 is compensated during a pixel driving process, which is equivalent to compensating the threshold voltage of the driving transistor T2.

Correspondingly, the present disclosure further provides a driving method for a pixel circuit. The driving method for the pixel circuit 40 is the same as the driving method for the pixel circuit 10 provided in the first embodiment. For a specific driving timing diagram, reference can be made to FIG. 3.

Similarly, during the threshold voltage sampling and data writing stage t4, the second scan signal provided by the second scan line Sn changes from the high level to the low level, the first transistor T1 and the third transistor T3 are turned on. During this process, the third scan signal provided by the initialization scan line Sv is maintained at the low level, the second transistor T2, the eighth transistor T8 and the tenth transistor T10 are all turned on, the data signal provided by the data line DATA is provided to the second node N2 via the first transistor T1, the tenth transistor T10 and the third transistor T3, and the second end of the tenth transistor T10 is electrically connected to the control end of the tenth transistor T10 (that is, the gate-drain of the tenth transistor T10 is short-circuited). At this point, the potential of the first node N1 is maintained at VINT2, and the potential of the second node N2 is VDATA+Vth, whereby the sampling of the threshold voltage Vth is completed.

Similarly, during the light emitting stage t7, the control signal provided by the emission control line EN changes from the high level to the low level, the fourth transistor T4, the fifth transistor T5 and the ninth transistor T9 are turned on. Since both the fourth transistor T4 and the ninth transistor T9 are turned on, the potential of the first node N1 jumps from the second initialization voltage VINT2 to the first power supply voltage Vdd, and at the same time, due to the coupling effect of the storage capacitor Cs, the potential of the second node N2 jumps to Vdd−VINT2+VDATA+Vth. At this point, the driving transistor T2 is turned on and outputs the current to drive the organic light emitting diode OLED to emit the light. The operating current Ioled of the organic light emitting diode OLED is equal to $K\times(VDATA-VINT2)^2$. It can be seen that the operating current Ioled is independent of the threshold voltage Vth of the driving transistor T2 and the first power supply voltage Vdd.

Correspondingly, the present disclosure further provides an organic light emitting display apparatus, and the organic light emitting display apparatus includes the pixel circuit 40 as described above. For details, reference may be made to the above description, which will not be repeated here.

Fifth Embodiment

Figure 7:
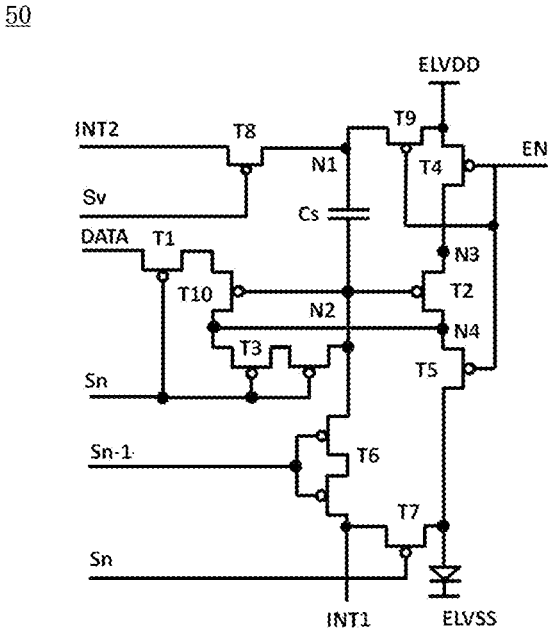
FIG. 7 is an equivalent circuit diagram of a pixel circuit according to a fifth embodiment of the present disclosure.

Reference is made to FIG. 7, which is an equivalent circuit diagram of a pixel circuit according to a fifth embodiment of the present disclosure. As shown in FIG. 7, a pixel circuit 50 includes: an organic light emitting diode OLED, connected between a first power supply ELVDD and a second power supply ELVSS; a first transistor T1, a first end of which is connected to a data line DATA, and a control end of which is connected to a second scan line Sn; a second transistor T2, a first end of which is connected to the third node N3, a second end of which is connected to a fourth node N4, and a control end of which is connected to a second node N2; a third transistor T3, a first end of which is connected to the second node N2, a second end of which is connected to the fourth node N4, and a control end of which is connected to the second scan line Sn; a fourth transistor T4, a first end of which is connected to the first power supply ELVDD, a second end of which is connected to the third node N3, and a control end of which is connected to an emission control line EN; a fifth transistor T5, a first end of which is connected to the fourth node N4, a second end of which is connected to an anode of the light emitting diode OLED, and a control end of which is connected to the emission control line EN; a sixth transistor T6, a first end of which is connected to the second node N2, a second end of which is connected to a first initialization signal end INTL and a control end of which is connected to a first scan line Sn-1; a seventh transistor T7, a first end of which is connected to the first initialization signal end INT1, a second end of which is connected to the anode of the light emitting diode OLED, and a control end of which is connected to the second scan line Sn; an eighth transistor T8, a first end of which is connected to a second initialization signal end INT2, a second end of which is connected to a first node N1, and a control end of which is connected to an initialization scan line Sv; a ninth transistor T9, a first end of which is connected to the first node N1, a second end of which is connected to the first power supply ELVDD, and a control end of which is connected to the emission control line EN; a tenth transistor T10, a first end of which is connected to a second end of the first transistor T1, a second end of which is connected to the fourth node N4, and a control end of which is connected to the second node N2; and a storage capacitor Cs, connected between the first node N1 and the second node N2.

Specifically, a difference between this embodiment and the second embodiment is that the pixel circuit 50 further includes the tenth transistor T10, and the tenth transistor T10 and the driving transistor T2 form a mirror structure. The threshold voltage of the tenth transistor T10 is compensated during a pixel driving process, which is equivalent to compensating the threshold voltage of the driving transistor T2.

Correspondingly, the present disclosure further provides a driving method for a pixel circuit. The driving method for the pixel circuit 50 is the same as the driving method for the pixel circuit 10 provided in the first embodiment. For a specific driving timing diagram, reference can be made to FIG. 3.

Correspondingly, the present disclosure further provides an organic light emitting display apparatus, and the organic light emitting display apparatus includes the pixel circuit 50 as described above. For details, reference may be made to the above description, which will not be repeated here.

Sixth Embodiment

Figure 8:
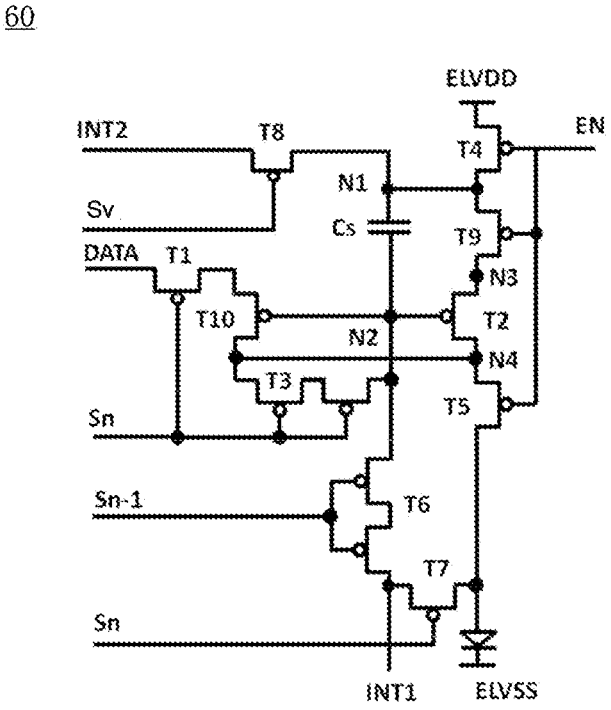
FIG. 8 is an equivalent circuit diagram of a pixel circuit according to a sixth embodiment of the present disclosure.

Reference is made to FIG. 8, which is an equivalent circuit diagram of a pixel circuit according to a sixth embodiment of the present disclosure. As shown in FIG. 8, a pixel circuit 60 includes: an organic light emitting diode OLED, connected between a first power supply ELVDD and a second power supply ELVSS; a first transistor T1, a first end of which is connected to a data line DATA, and a control end of which is connected to a second scan line Sn; a second transistor T2, a first end of which is connected to the third node N3, a second end of which is connected to a fourth node N4, and a control end of which is connected to a second node N2; a third transistor T3, a first end of which is connected to the second node N2, a second end of which is connected to the fourth node N4, and a control end of which is connected to the second scan line Sn; a fourth transistor T4, a first end of which is connected to the first power supply ELVDD, a second end of which is connected to a first node N1, and a control end of which is connected to an emission control line EN; a fifth transistor T5, a first end of which is connected to the fourth node N4, a second end of which is connected to an anode of the light emitting diode OLED, and a control end of which is connected to the emission control line EN; a sixth transistor T6, a first end of which is connected to the second node N2, a second end of which is connected to a first initialization signal end INT1, and a control end of which is connected to a first scan line Sn-1; a seventh transistor T7, a first end of which is connected to the first initialization signal end INT1, a second end of which is connected to the anode of the light emitting diode OLED, and a control end of which is connected to the second scan line Sn; an eighth transistor T8, a first end of which is connected to a second initialization signal end INT2, a second end of which is connected to the first node N1, and a control end of which is connected to an initialization scan line Sv; a ninth transistor T9, a first end of which is connected to the first node N1, a second end of which is connected to the third node N3, and a control end of which is connected to the emission control line EN; a tenth transistor T10, a first end of which is connected to a second end of the first transistor T1, a second end of which is connected to the fourth node N4, and a control end of which is connected to the second node N2; and a storage capacitor Cs, connected between the first node N1 and the second node N2.

Specifically, a difference between this embodiment and the third embodiment is that the pixel circuit 60 further includes the tenth transistor T10, and the tenth transistor T10 and the driving transistor T2 form a mirror structure. The threshold voltage of the tenth transistor T10 is compensated during a driving process, which is equivalent to compensating the threshold voltage of the driving transistor T2.

Correspondingly, the present disclosure further provides a driving method for a pixel circuit. The driving method for the pixel circuit 60 is the same as the driving method for the pixel circuit 10 provided in the first embodiment. For a specific driving timing diagram, reference can be made to FIG. 3.

Correspondingly, the present disclosure further provides an organic light emitting display apparatus, and the organic light emitting display apparatus includes the pixel circuit 60 as described above. For details, reference may be made to the above description, which will not be repeated here.

It should be noted that various embodiments in this specification are described in a progressive manner, and each embodiment focuses on differences from other embodiments, and the same or similar parts between the various embodiments can be referred to each other.

The above drawings merely schematically show the pixel circuit provided by the present disclosure. For the sake of clarity, shapes and quantity of components in the above figures are simplified, and some components are omitted. Those skilled in the art can make changes according to actual needs. These changes are within the protection scope of the present disclosure and will not be repeated here.

In summary, in the pixel circuit and the driving method thereof, and the organic light emitting display apparatus provided by the present disclosure, the compensation for the threshold voltage and the IR Drop is realized through the cooperation of the sampling unit and the compensation unit, thereby improving the problem of uneven display of the organic light emitting display apparatus.

The above content is a further detailed description of the present disclosure in combination with specific embodiments, and it cannot be considered that the specific implementations of the present disclosure are limited to these descriptions. For those of ordinary skill in the technical field to which the present disclosure belongs, a number of simple deductions or substitutions can be made without departing from the concept of the present disclosure, which should be regarded as falling within the protection scope of the present disclosure.

What is claimed is:

1. A pixel circuit, comprising:

an organic light emitting diode, connected between a first power supply and a second power supply;

a first transistor, a first end of which is connected to a data line, a second end of which is connected to a third node, and a control end of which is connected to a second scan line;

a second transistor, a first end of which is connected to the third node, a second end of which is connected to a fourth node, and a control end of which is connected to a second node;

a third transistor, a first end of which is connected to the second node, a second end of which is connected to the fourth node, and a control end of which is connected to the second scan line;

a fifth transistor, a first end of which is connected to the fourth node, a second end of which is connected to an anode of the organic light emitting diode, and a control end of which is connected to an emission control line;

a sixth transistor, a first end of which is connected to the second node, a second end of which is connected to a first initialization signal end, and a control end of which is connected to a first scan line;

a seventh transistor, a first end of which is connected to the first initialization signal end, a second end of which is connected to the anode of the organic light emitting diode, and a control end of which is connected to the second scan line;

a storage capacitor, connected between a first node and the second node; and a compensation unit, a first input end of which is connected to the first power supply, a second input end of which is connected to a second initialization signal end, a first output end of which is connected to the first node, and a second output end of which is connected to the third node.

2. The pixel circuit according to claim 1, wherein the compensation unit comprises: a fourth transistor, an eighth transistor and a ninth transistor;

a first end of the fourth transistor is connected to the first power supply, a second end of the fourth transistor is connected to the third node, a first end of the ninth transistor is connected to the first node, a second end of the ninth transistor is connected to the third node, and a control end of the fourth transistor and a control end of the ninth transistor are both connected to the emission control line; and a first end of the eighth transistor is connected to the second initialization signal end, a second end of the eighth transistor is connected to the first node, and a control end of the eighth transistor is connected to an initialization scan line.

3. The pixel circuit according to claim 1, wherein the compensation unit comprises: a fourth transistor, an eighth transistor and a ninth transistor;

a first end of the fourth transistor is connected to the first power supply, a second end of the fourth transistor is connected to the third node, a first end of the ninth transistor is connected to the first node, a second end of the ninth transistor is connected to the first power supply, and a control end of the fourth transistor and a control end of the ninth transistor are both connected to the emission control line; and a first end of the eighth transistor is connected to the second initialization signal end, a second end of the eighth transistor is connected to the first node, and a control end of the eighth transistor is connected to an initialization scan line.

4. The pixel circuit according to claim 1, wherein the compensation unit comprises: a fourth transistor, an eighth transistor and a ninth transistor;

a first end of the fourth transistor is connected to the first power supply, a second end of the fourth transistor is connected to the first node, a first end of the ninth transistor is connected to the first node, a second end of the ninth transistor is connected to the third node, and a control end of the fourth transistor and a control end of the ninth transistor are both connected to the emission control line; and a first end of the eighth transistor is connected to the second initialization signal end, a second end of the eighth transistor is connected to the first node, and a control end of the eighth transistor is connected to an initialization scan line.

5. An organic light emitting display apparatus, comprising: the pixel circuit according to claim 1.

6. The organic light emitting display apparatus according to claim 5, wherein the compensation unit comprises: a fourth transistor, an eighth transistor and a ninth transistor;

a first end of the fourth transistor is connected to the first power supply, a second end of the fourth transistor is connected to the third node, a first end of the ninth transistor is connected to the first node, a second end of the ninth transistor is connected to the third node, and a control end of the fourth transistor and a control end of the ninth transistor are both connected to the emission control line; and a first end of the eighth transistor is connected to the second initialization signal end, a second end of the eighth transistor is connected to the first node, and a control end of the eighth transistor is connected to an initialization scan line.

7. The organic light emitting display apparatus according to claim 5, wherein the compensation unit comprises: a fourth transistor, an eighth transistor and a ninth transistor;

a first end of the fourth transistor is connected to the first power supply, a second end of the fourth transistor is connected to the third node, a first end of the ninth transistor is connected to the first node, a second end of the ninth transistor is connected to the first power supply, and a control end of the fourth transistor and a control end of the ninth transistor are both connected to the emission control line; and a first end of the eighth transistor is connected to the second initialization signal end, a second end of the eighth transistor is connected to the first node, and a control end of the eighth transistor is connected to an initialization scan line.

8. The organic light emitting display apparatus according to claim 5, wherein the compensation unit comprises: a fourth transistor, an eighth transistor and a ninth transistor;

a first end of the fourth transistor is connected to the first power supply, a second end of the fourth transistor is connected to the first node, a first end of the ninth transistor is connected to the first node, a second end of the ninth transistor is connected to the third node, and a control end of the fourth transistor and a control end of the ninth transistor are both connected to the emission control line; and a first end of the eighth transistor is connected to the second initialization signal end, a second end of the eighth transistor is connected to the first node, and a control end of the eighth transistor is connected to an initialization scan line.

9. A pixel circuit, comprising:

an organic light emitting diode, connected between a first power supply and a second power supply;

a first transistor, a first end of which is connected to a data line and a control end of which is connected to a second scan line;

a second transistor, a first end of which is connected to a third node, a second end of which is connected to a fourth node, and a control end of which is connected to a second node;

a third transistor, a first end of which is connected to the second node, a second end of which is connected to the fourth node, and a control end of which is connected to the second scan line;

a fifth transistor, a first end of which is connected to the fourth node, a second end of which is connected to an anode of the organic light emitting diode, and a control end of which is connected to an emission control line;

a sixth transistor, a first end of which is connected to the second node, a second end of which is connected to a first initialization signal end, and a control end of which is connected to a first scan line;

a seventh transistor, a first end of which is connected to the first initialization signal end, a second end of which is connected to the anode of the organic light emitting diode, and a control end of which is connected to the second scan line;

a tenth transistor, a first end of which is connected to a second end of the first transistor, a second end of which is connected to the fourth node, and a control end of which is connected to the second node;

a storage capacitor, connected between a first node and the second node; and a compensation unit, a first input end of which is connected to the first power supply, a second input end of which is connected to a second initialization signal end, a first output end of which is connected to the first node, and a second output end of which is connected to the third node.

10. The pixel circuit according to claim 9, wherein the compensation unit comprises: a fourth transistor, an eighth transistor and a ninth transistor;

a first end of the fourth transistor is connected to the first power supply, a second end of the fourth transistor is connected to the third node, a first end of the ninth transistor is connected to the first node, a second end of the ninth transistor is connected to the third node, and a control end of the fourth transistor and a control end of the ninth transistor are both connected to the emission control line; and a first end of the eighth transistor is connected to the second initialization signal end, a second end of the eighth transistor is connected to the first node, and a control end of the eighth transistor is connected to an initialization scan line.

11. The pixel circuit according to claim 9, wherein the compensation unit comprises: a fourth transistor, an eighth transistor and a ninth transistor;

a first end of the fourth transistor is connected to the first power supply, a second end of the fourth transistor is connected to the third node, a first end of the ninth transistor is connected to the first node, a second end of the ninth transistor is connected to the first power supply, and a control end of the fourth transistor and a control end of the ninth transistor are both connected to the emission control line; and a first end of the eighth transistor is connected to the second initialization signal end, a second end of the eighth transistor is connected to the first node, and a control end of the eighth transistor is connected to an initialization scan line.

12. The pixel circuit according to claim 9, wherein the compensation unit comprises: a fourth transistor, an eighth transistor and a ninth transistor;

a first end of the fourth transistor is connected to the first power supply, a second end of the fourth transistor is connected to the first node, a first end of the ninth transistor is connected to the first node, a second end of the ninth transistor is connected to the third node, and a control end of the fourth transistor and a control end of the ninth transistor are both connected to the emission control line; and a first end of the eighth transistor is connected to the second initialization signal end, a second end of the eighth transistor is connected to the first node, and a control end of the eighth transistor is connected to an initialization scan line.

13. A driving method for a pixel circuit, comprising:

providing the pixel circuit according to claim 9, wherein the compensation unit comprises a fourth transistor, an eighth transistor and a ninth transistor, and wherein a scanning cycle of the pixel circuit comprises an initialization stage, a threshold voltage sampling and data writing stage and a light emitting stage, and the threshold voltage sampling and data writing stage is between the initialization stage and the light emitting stage;

in the initialization stage, turning on the sixth transistor and transmitting a first initialization signal to the second node through the sixth transistor, and simultaneously turning on the eighth transistor and transmitting a second initialization signal to the first node through the eighth transistor;

in the threshold voltage sampling and data writing stage, turning on the first transistor and transmitting a data signal provided by the data line to the second node through the first transistor, and simultaneously turning on the third transistor to electrically connect the second end of the tenth transistor with the control end of the tenth transistor; and in the light emitting stage, turning on the fourth transistor, the fifth transistor and the ninth transistor, so that the second transistor is turned on to drive the organic light emitting diode to emit light.

14. An organic light emitting display apparatus, comprising: the pixel circuit according to claim 9.

15. The organic light emitting display apparatus according to claim 14, wherein the compensation unit comprises: a fourth transistor, an eighth transistor and a ninth transistor;

a first end of the fourth transistor is connected to the first power supply, a second end of the fourth transistor is connected to the third node, a first end of the ninth transistor is connected to the first node, a second end of the ninth transistor is connected to the third node, and a control end of the fourth transistor and a control end of the ninth transistor are both connected to the emission control line; and a first end of the eighth transistor is connected to the second initialization signal end, a second end of the eighth transistor is connected to the first node, and a control end of the eighth transistor is connected to an initialization scan line.

16. The organic light emitting display apparatus according to claim 14, wherein the compensation unit comprises: a fourth transistor, an eighth transistor and a ninth transistor;

a first end of the fourth transistor is connected to the first power supply, a second end of the fourth transistor is connected to the third node, a first end of the ninth transistor is connected to the first node, a second end of the ninth transistor is connected to the first power supply, and a control end of the fourth transistor and a control end of the ninth transistor are both connected to the emission control line; and a first end of the eighth transistor is connected to the second initialization signal end, a second end of the eighth transistor is connected to the first node, and a control end of the eighth transistor is connected to an initialization scan line.

17. The organic light emitting display apparatus according to claim 14, wherein the compensation unit comprises: a fourth transistor, an eighth transistor and a ninth transistor;

a first end of the fourth transistor is connected to the first power supply, a second end of the fourth transistor is connected to the first node, a first end of the ninth transistor is connected to the first node, a second end of the ninth transistor is connected to the third node, and a control end of the fourth transistor and a control end of the ninth transistor are both connected to the emission control line; and a first end of the eighth transistor is connected to the second initialization signal end, a second end of the eighth transistor is connected to the first node, and a control end of the eighth transistor is connected to an initialization scan line.

18. A driving method for a pixel circuit, comprising:

providing a pixel circuit, wherein the pixel circuit comprises:

an organic light emitting diode, connected between a first power supply and a second power supply;

a first transistor, a first end of which is connected to a data line, a second end of which is connected to a third node, and a control end of which is connected to a second scan line;

a second transistor, a first end of which is connected to the third node, a second end of which is connected to a fourth node, and a control end of which is connected to a second node;

a third transistor, a first end of which is connected to the second node, a second end of which is connected to the fourth node, and a control end of which is connected to the second scan line;

a fifth transistor, a first end of which is connected to the fourth node, a second end of which is connected to an anode of the organic light emitting diode, and a control end of which is connected to an emission control line;

a sixth transistor, a first end of which is connected to the second node, a second end of which is connected to a first initialization signal end, and a control end of which is connected to a first scan line;

a seventh transistor, a first end of which is connected to the first initialization signal end, a second end of which is connected to the anode of the organic light emitting diode, and a control end of which is connected to the second scan line;

a storage capacitor, connected between a first node and the second node; and a compensation unit, a first input end of which is connected to the first power supply, a second input end of which is connected to a second initialization signal end, a first output end of which is connected to the first node, and a second output end of which is connected to the third node, wherein the compensation unit comprises a fourth transistor, an eighth transistor and a ninth transistor;

wherein a scanning cycle of the pixel circuit comprises an initialization stage, a threshold voltage sampling and data writing stage and a light emitting stage, and the threshold voltage sampling and data writing stage is between the initialization stage and the light emitting stage;

in the initialization stage, turning on the sixth transistor and transmitting a first initialization signal to the second node through the sixth transistor, and simultaneously turning on the eighth transistor and transmitting a second initialization signal to the first node through the eighth transistor;

in the threshold voltage sampling and data writing stage, turning on the first transistor and transmitting a data signal provided by the data line to the third node through the first transistor, and simultaneously turning on the third transistor to electrically connect the second end of the second transistor with the control end of the second transistor; and in the light emitting stage, turning on the fourth transistor, the fifth transistor and the ninth transistor, so that the second transistor is turned on to drive the organic light emitting diode to emit light.

* * * * *